US009114607B2

(12) United States Patent
Ishii et al.

(10) Patent No.: US 9,114,607 B2
(45) Date of Patent: Aug. 25, 2015

(54) INKJET PRINTING APPARATUS AND DRIVING METHOD

(71) Applicant: CANON KABUSHIKI KAISHA, Tokyo (JP)

(72) Inventors: Yosuke Ishii, Kawasaki (JP); Kazuo Suzuki, Yokohama (JP); Hiroaki Shirakawa, Kawasaki (JP); Mitsutoshi Nagamura, Tokyo (JP); Yuhei Oikawa, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 49 days.

(21) Appl. No.: 13/782,404

(22) Filed: Mar. 1, 2013

(65) Prior Publication Data

US 2013/0235104 A1 Sep. 12, 2013

(30) Foreign Application Priority Data

Mar. 6, 2012 (JP) ..... 2012-049196

(51) Int. Cl.
*B41J 29/38* (2006.01)
*B41J 2/045* (2006.01)

(52) U.S. Cl.
CPC ..... *B41J 2/04573* (2013.01); *B41J 2/0458* (2013.01); *B41J 2/04543* (2013.01); *B41J 2/04563* (2013.01); *B41J 2/04591* (2013.01); *B41J 2/04598* (2013.01)

(58) Field of Classification Search
CPC ..... B41J 2/04588; B41J 2/04581; B41J 2/04596; B41J 2/04541; B41J 2/04593
USPC ..... 347/10, 11, 14
See application file for complete search history.

(56) References Cited

U.S. PATENT DOCUMENTS

| | | | | |
|---|---|---|---|---|
| 6,331,039 | B1 * | 12/2001 | Iwasaki et al. | 347/11 |
| 7,270,389 | B2 * | 9/2007 | Inoue et al. | 347/11 |
| 2007/0217498 | A1 * | 9/2007 | Tenconi | 375/238 |

FOREIGN PATENT DOCUMENTS

JP 2002-240254 A 8/2002

* cited by examiner

*Primary Examiner* — Manish S Shah
*Assistant Examiner* — Yaovi Ameh
(74) *Attorney, Agent, or Firm* — Fitzpatrick, Cella, Harper & Scinto

(57) ABSTRACT

Provided are an inkjet printing apparatus, whereby pulse drive periods and a pause period can be adjusted so as to fall within predetermined periods, while the volume of ink to be ejected is ensured, and a heat generating element driving method therefor. For the inkjet printing apparatus, a pulse signal drive period for a pulse driven previously, a pulse signal drive period for a pulse driven subsequently and a pause period are set to perform ejection of ink droplets one time. When the ejection period exceeds the threshold value, the pulse signal drive period for the pulse driven subsequently and the pause period are reduced to adjust the ejection period to be equal to or lower than a threshold value.

16 Claims, 14 Drawing Sheets

■P1<0.2 μ sec

⋮

■0.2 μ sec≦P1<0.3 μ sec

| EXCESS AMOUNT x (μs) | P1 ADJUSTMENT VALUE (μs) | P2 ADJUSTMENT VALUE (μs) | P3 ADJUSTMENT VALUE (μs) |
|---|---|---|---|
| x=0.000 | 0.000 | 0.000 | 0.000 |
| 0.000<x≦0.008 | 0.001 | −0.007 | −0.002 |
| 0.008<x≦0.016 | 0.001 | −0.014 | −0.003 |
| 0.016<x≦0.024 | 0.002 | −0.022 | −0.005 |
| 0.024<x≦0.032 | 0.003 | −0.029 | −0.006 |
| 0.032<x≦0.040 | 0.004 | −0.036 | −0.008 |
| 0.040<x≦0.048 | 0.004 | −0.043 | −0.009 |
| 0.048<x≦0.056 | 0.005 | −0.050 | −0.011 |
| 0.056<x≦0.064 | 0.006 | −0.058 | −0.012 |
| 0.064<x≦0.072 | 0.006 | −0.065 | −0.014 |
| 0.072<x≦0.080 | 0.007 | −0.072 | −0.015 |
| 0.080<x≦0.088 | 0.008 | −0.079 | −0.017 |
| 0.088<x≦0.096 | 0.009 | −0.086 | −0.018 |
| 0.096<x≦0.104 | 0.009 | −0.094 | −0.020 |

■0.3 μ sec≦P1<0.4 μ sec

| EXCESS AMOUNT x (μs) | P1 ADJUSTMENT VALUE (μs) | P2 ADJUSTMENT VALUE (μs) | P3 ADJUSTMENT VALUE (μs) |
|---|---|---|---|
| x=0.000 | 0.000 | 0.000 | 0.000 |
| 0.000<x≦0.008 | 0.001 | −0.007 | −0.002 |
| 0.008<x≦0.016 | 0.002 | −0.014 | −0.004 |
| 0.016<x≦0.024 | 0.003 | −0.022 | −0.006 |
| 0.024<x≦0.032 | 0.004 | −0.029 | −0.008 |
| 0.032<x≦0.040 | 0.005 | −0.036 | −0.009 |
| 0.040<x≦0.048 | 0.006 | −0.043 | −0.011 |
| 0.048<x≦0.056 | 0.008 | −0.050 | −0.013 |
| 0.056<x≦0.064 | 0.009 | −0.058 | −0.015 |
| 0.064<x≦0.072 | 0.010 | −0.065 | −0.017 |
| 0.072<x≦0.080 | 0.011 | −0.072 | −0.019 |
| 0.080<x≦0.088 | 0.012 | −0.079 | −0.021 |
| 0.088<x≦0.096 | 0.013 | −0.086 | −0.023 |
| 0.096<x≦0.104 | 0.014 | −0.094 | −0.024 |

■0.4 μ sec≦P1

⋮

FIG.10

RATIO OF P2 ADJUSTMENT VALUE TO P3 ADJUSTMENT VALUE
⇒ NOT DEPEND ON P1

| EXCESS AMOUNT x (μs) | P2 ADJUSTMENT VALUE (μs) | P3 ADJUSTMENT VALUE (μs) |
|---|---|---|
| x=0.000 | 0.000 | 0.000 |
| 0.000<x≦0.008 | −0.007 | −0.001 |
| 0.008<x≦0.016 | −0.015 | −0.001 |
| 0.016<x≦0.024 | −0.022 | −0.002 |
| 0.024<x≦0.032 | −0.029 | −0.003 |
| 0.032<x≦0.040 | −0.036 | −0.004 |
| 0.040<x≦0.048 | −0.044 | −0.004 |
| 0.048<x≦0.056 | −0.051 | −0.005 |
| 0.056<x≦0.064 | −0.058 | −0.006 |
| 0.064<x≦0.072 | −0.065 | −0.007 |
| 0.072<x≦0.080 | −0.073 | −0.007 |
| 0.080<x≦0.088 | −0.080 | −0.008 |
| 0.088<x≦0.096 | −0.087 | −0.009 |
| 0.096<x≦0.104 | −0.095 | −0.009 |

FIG.13

| EJECTION FREQUENCY [kHz] | 15 | 12 | 10 |
|---|---|---|---|
| UPPER LIMIT VALUE [μsec] FOR TOTAL PULSE WIDTH | 1.33 | 1.67 | 2.00 |

FIG.14

INKJET PRINTING APPARATUS AND DRIVING METHOD

BACKGROUND OF THE INVENTION

1. Field of the Invention

The present invention relates to an inkjet printing apparatus, wherein heat is generated by applying a drive pulse to heat generating elements provided for a print head, and is employed for the ejection of ink to perform printing, and to a driving method for driving the heat generating elements.

2. Description of the Related Art

As a recent trend, inkjet printing apparatuses, which perform printing by ejecting ink from print heads, are employed as image forming apparatuses for forming images on printing media. Some of these inkjet printing apparatuses employ a printing method whereby heat generating elements are heated by the application of drive pulses, and bubbles are generated on the heat generating elements in ink to perform the ejection of ink onto printing media. For the inkjet printing apparatuses of this type, the heat generating elements may be driven by applying double pulses to perform the ejection of ink. When a double-pulse inkjet printing apparatus drives the heat generating elements, first, the heat generating elements are driven by applying a pulse that is not accompanied by the ejection of ink droplets, then, driving of the heat generating elements is paused, and thereafter, a pulse for the ejection of ink droplets is applied to the heat generating elements that are to be driven.

When the ejection of ink is to be performed by the application of double pulses, the heat generating elements are driven by applying a first pulse that is not accompanied by the ejection of ink droplets, and ink around the heat generating elements is heated. Then, when a pause period has elapsed, the heat generating elements are driven again to eject ink droplets. In a case wherein the application of double pulses is employed in this manner to eject ink, the periods for applying the individual pulses and the period for the paused state are adjusted in accordance with the printing condition.

In Japanese Patent Laid-Open No. 2002-240254, an inkjet printing apparatus is disclosed that employs double pulses for the ejection of ink, and that adjusts the lengths of pulse drive periods and a pause period in accordance with a voltage drop that has occurred when ink is ejected from a plurality of ejection ports by driving heat generating elements in a time-division manner.

The length of the pulse drive periods and the length of the pause period may also be limited depending on the other condition. Especially when the ink ejection frequency is to be increased to raise the printing speed, it is required that the pulse drive periods and the pause period be reduced.

However, when the pulse drive periods and the pause period are merely reduced, there is a possibility that a desired volume of ink will not be ejected. Further, in a case wherein the pulse drive periods are extended to ensure a desired volume of ink will be ejected, there is a possibility that the total of the pulse drive periods and the pause period may not fall within a required period of time. In such a case, the ink ejection frequency cannot be increased, and a desired printing speed may not be obtained.

SUMMARY OF THE INVENTION

While taking the above described shortcomings into account, one objective of the present invention is to provide an inkjet printing apparatus, for which pulse drive periods and a pause period can be controlled, so that these periods can fall within predetermined periods, while the volume of ink to be ejected is ensured, and also to provide a method for driving heat generating elements employed for this inkjet printing apparatus.

According to the present invention, an inkjet printing apparatus, which includes a print head where ejection ports are formed and heat generating elements are arranged in flow paths that communicate with the ejection ports, and where pulse signals that include a first pulse signal, which is to be driven previously and does not accompany ejection of ink droplets, and a second pulse signal, which is to be driven subsequently in order to eject ink droplets, are applied to the heat generating elements to generate heat, and the heat generated by the heat generating elements is employed to eject ink droplets from the ejection ports, the inkjet printing apparatus comprising: a setting unit for setting, in order to perform ejection of ink droplets one time, a first pulse signal drive period for driving the first pulse signal, a second pulse signal drive period for driving the second pulse signal, and a pause period between drive by the first pulse signal and drive by the second pulse signal; a determination unit for determining whether an ejection period, obtained by adding the first pulse drive period, the second pulse drive period and the pause period that are set by the setting unit, exceeds a threshold value for the ejection period designated in advance; and an adjustment unit for adjusting the ejection period so that the ejection period is equal to or lower than the threshold value by reducing the second pulse signal drive period and the pause period, in case that the ejection period exceeds the threshold value.

Further, according to the present invention, a drive method for driving a heat generating element, in order to perform ejection of ink droplets from an inkjet printing apparatus that includes a print head where ejection ports are formed and the heat generating elements are arranged in flow paths that communicate with the ejection ports, and where pulse signals that include a first pulse signal, which is to be driven previously and does not accompany ejection of ink droplets, and a second pulse signal, which is to be driven subsequently in order to eject ink droplets, are applied to the heat generating elements per one ejection of ink droplet, to generate heat, and the heat generated by the heat generating elements is employed to eject ink droplets from the ejection ports, the drive method comprising: a setting step of setting, in order to perform ejection of ink droplets one time, a first pulse signal drive period for driving the first pulse signal, a second pulse signal drive period for driving the second pulse signal, and a pause period between drive by the first pulse signal and drive by the second pulse signal; a determination step of determining whether an ejection period, obtained by adding the first pulse drive period, the second pulse drive period and the pause period that are set at the setting step, exceeds a threshold value for the ejection period designated in advance; and an adjustment step of adjusting the ejection period so that the ejection period is equal to or lower than the threshold value by reducing the second pulse signal drive period and the pause period, in case that the ejection period exceeds the threshold value.

According to the present invention, the pulse drive periods and the pause period can be controlled, so that these periods can be fit within predetermined periods, while the volume of ink to be ejected is maintained. Therefore, the printing speed of the inkjet printing apparatus can be increased, and the printing efficiency can be improved.

Further features of the present invention will become apparent from the following description of exemplary embodiments (with reference to the attached drawings).

BRIEF DESCRIPTION OF THE DRAWINGS

FIG. 10 is a table wherein various sets, each consisting of an adjustment value for the pulse drive period driven previously, an adjustment value for the pause period and an adjustment value for the pulse drive period driven subsequently, are stored, and are to be employed by the inkjet printing apparatus in FIG. 1A to 1C when adjusting the pulse drive period driven previously, the pause period and the pulse drive period driven subsequently;

FIG. 13 is a table where various sets, each consisting of an adjustment value for the pulse drive period driven subsequently and an adjustment value for the pause period, are stored and are to be employed by the inkjet printing apparatus of the second embodiment when adjusting the individual pulse drive periods and the pause period; and FIG. 14 is a table showing the upper limit values of the total pulse widths, for the individual ejection frequencies, that are employed by an inkjet printing apparatus according to a fourth embodiment of the present invention when adjusting the individual pulse drive periods and the pause period.

DESCRIPTION OF THE EMBODIMENTS

An inkjet printing apparatus according to the embodiments of the present invention will now be described while referring to the accompanying drawings.

First Embodiment

First, the arrangement and the printing operation will be described of an inkjet printing apparatus 100 according to a first embodiment of the present invention.

Figure 1A:
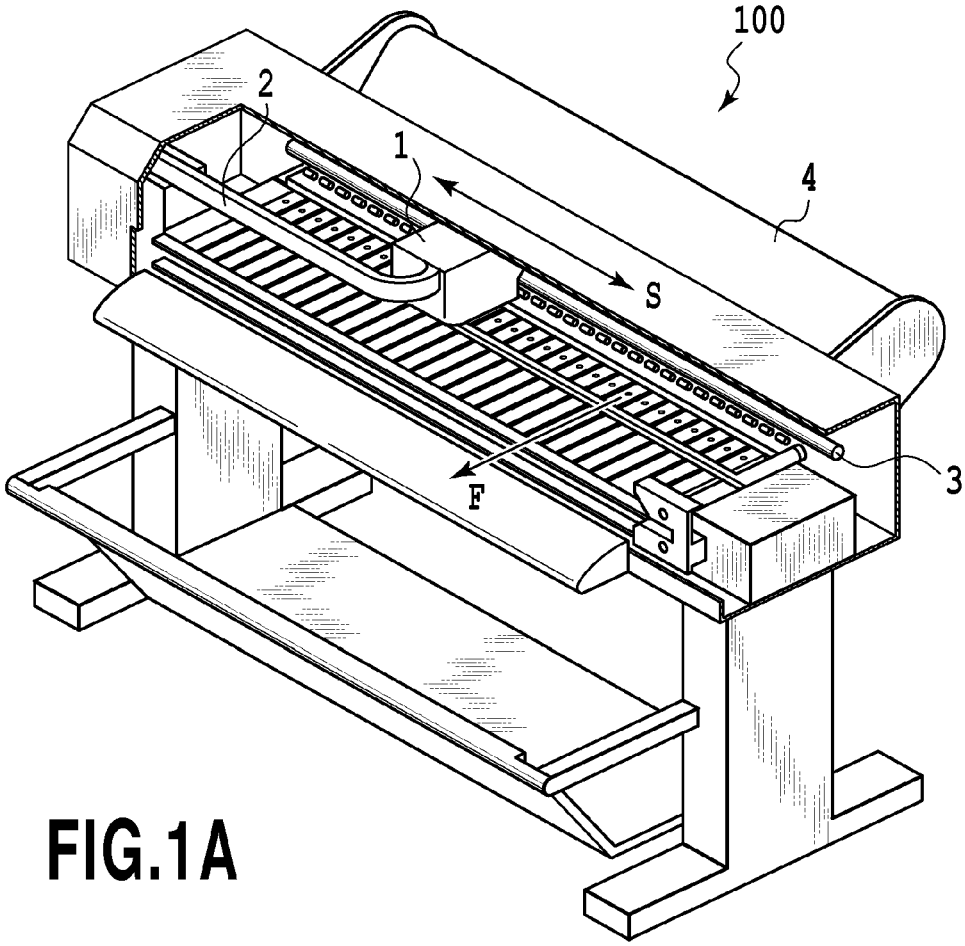
FIG. 1A is a partially exploded, perspective view of an inkjet printing apparatus according to a first embodiment of the present invention.
Figure 1B:
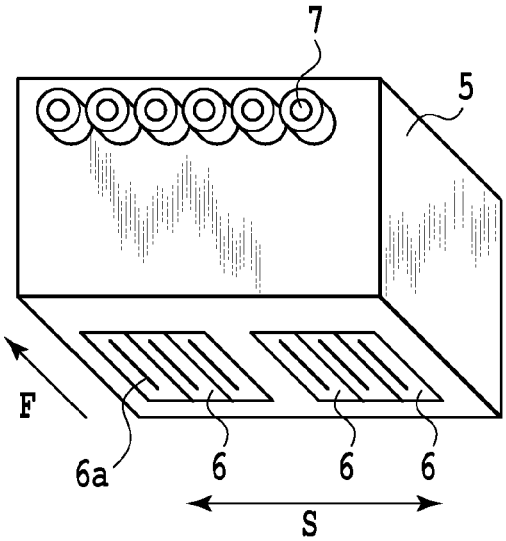
FIG. 1B is a perspective view of a print head, which is mounted on the inkjet printing apparatus in FIG. 1A.
Figure 1C:
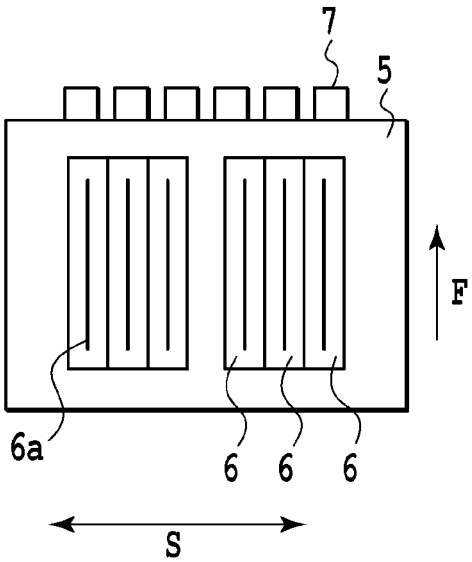
FIG. 1C is a plan view of the print head shown in FIG. 1B.

FIG. 1A is a partially exploded perspective view of the internal mechanism of the inkjet printing apparatus 100 of this embodiment. FIG. 1B is a perspective view of a print head 5 mounted on a carriage 1 of the inkjet printing apparatus 100 shown in FIG. 1A. FIG. 1C is a plan view of an ejection port formation face of the print head 5 positioned opposite the face of a printing medium 4.

As illustrated by FIG. 1A, a conveying motor (not shown) is driven and conveys the printing medium 4 in a direction indicated by an arrow F. A guide shaft 3 is extended in a direction perpendicular to the direction F in which the printing medium 4 is conveyed. The carriage 1 (scanning means), on which the print head 5 is mounted, is supported by the guide shaft 3, and is reciprocally moved, while reciprocal scanning is performed, by driving of a carriage motor (not shown), in a direction indicated by an arrow S (a main scan direction). During the movement of the carriage 1 in the direction S, ink is ejected, based on print data, onto the printing medium 4 by the print head 5 mounted on the carriage 1, and in this manner, the printing onto the printing medium 4 is performed.

Six ejection port formation boards 6 are provided for the print head 5, and ejection port arrays 6*a* are formed in the individual ejection port formation boards 6 in a direction perpendicular to the main scan direction. Furthermore, joints 7 are formed for the print head 5, and these are connected to an ink supply path 2 that is extended from an ink tank (not shown), which is arranged so separated from the print head 5. Thus, ink from the ink tank is supplied, via the ink supply path 2 and the joints 7, to the interior of the print head 5.

The inkjet printing apparatus 100 of this embodiment employs a so-called bi-directional printing system that prints onto a printing medium by ejecting ink both when the print head 5 is moved along the forward path, and when the print head 5 is moved along the reverse path. When scanning and printing using the print head 5 has been performed, the printing medium 4 is conveyed a predetermined distance by the conveying motor (not shown).

Figure 2:
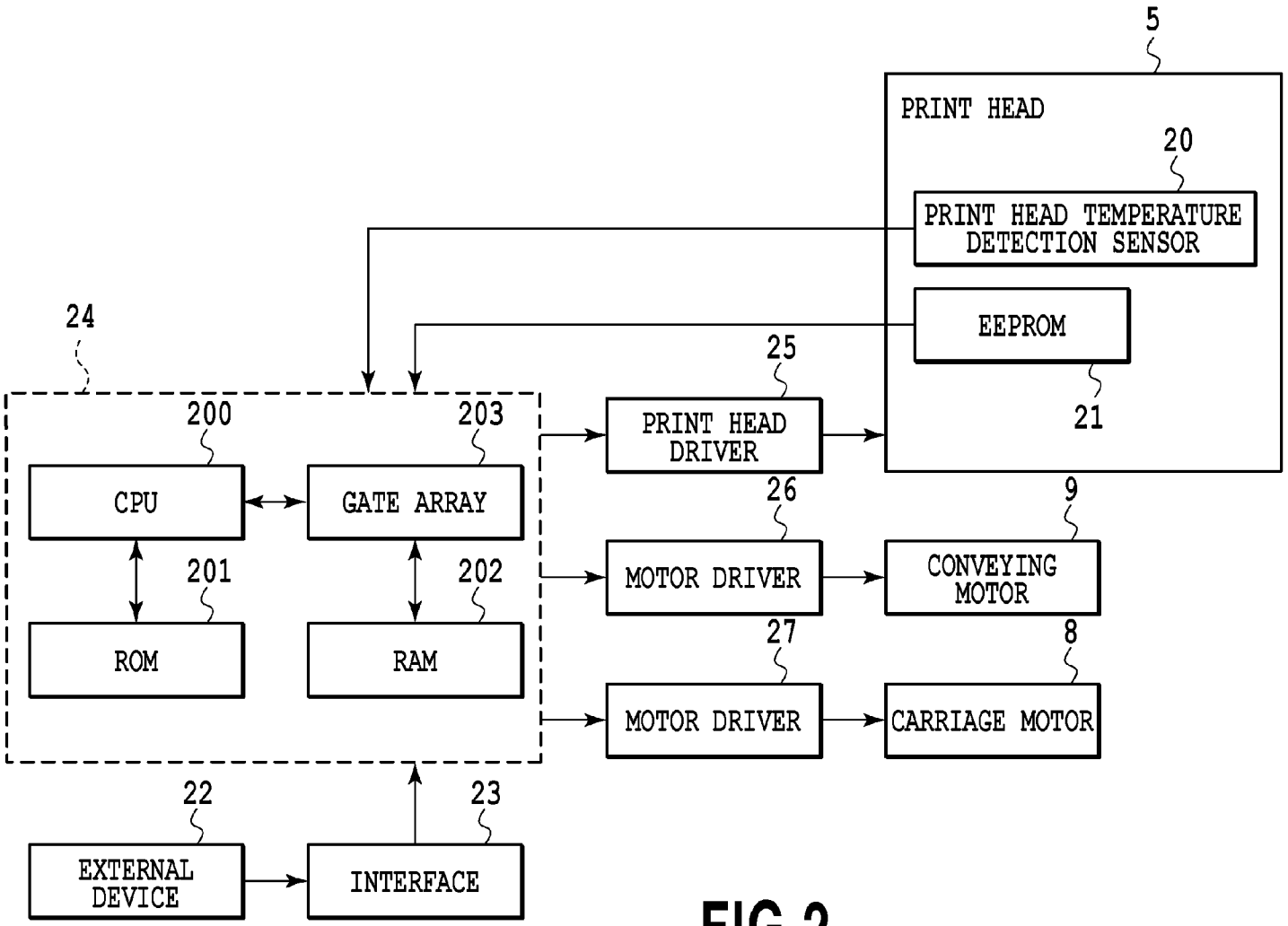
FIG. 2 is a schematic block diagram illustrating the arrangement of the control system of the inkjet printing apparatus shown in FIGS. 1A to 1C.

FIG. 2 is a block diagram illustrating the control configuration of the inkjet printing apparatus 100 shown in FIG. 1A.

As shown in FIG. 2, a controller 24 of the inkjet printing apparatus 100 includes an interface 23, a CPU 200, a ROM 201 and a RAM 202. The interface 23 is employed to input image data from an external device 22. The ROM 201 serves as a memory used to store a program that is to be executed by the CPU 200. The RAM 202 is employed to store various data, such as image data and print signals to be transmitted to the print head 5, that are employed for controlling the inkjet printing apparatus 100. A gate array 203 transmits a print signal to the print head 5, and also performs a data transfer with respect to the interface 23, the CPU 200 and the RAM 202.

A print head driver 25 drives the print head 5 based on a print signal output by the controller 24 in order to perform the ejection of ink. A motor driver 26 drives a conveying motor 9, based on a signal output by the controller 24, in order to perform the printing medium conveying operation. A motor driver 27 drives a carriage motor 8, based on a signal output by the controller 24, in order to move the print head 5 to a predetermined printing position in the main scan direction. Further, the print head 5 includes a print head temperature detection sensor 20 for detecting the temperature of the print head 5. The print head 5 also includes an EEPROM 21 that is employed to store initial properties for the print head 5, such as the volume of the ink ejected by the print head 5 and the resistances of the heat generating elements and the wiring, that are obtained during the course of a shop inspection.

When image data is received from the external device 22 via the interface 23, the controller 24 employs the gate array 203 and the CPU 200 to convert the image data into print data, and stores the obtained print data in the RAM 202. Further, the controller 24 synchronously drives the motor drivers 26 and 27, and the print head driver 25, to perform the printing operation using the print head 5, the printing medium conveying operation and the reciprocal movement of the print head 5 in the main scan direction. As a result, based on the image data, an image is formed on the printing medium 4, i.e., printing is performed for the printing medium 4.

Figure 3:
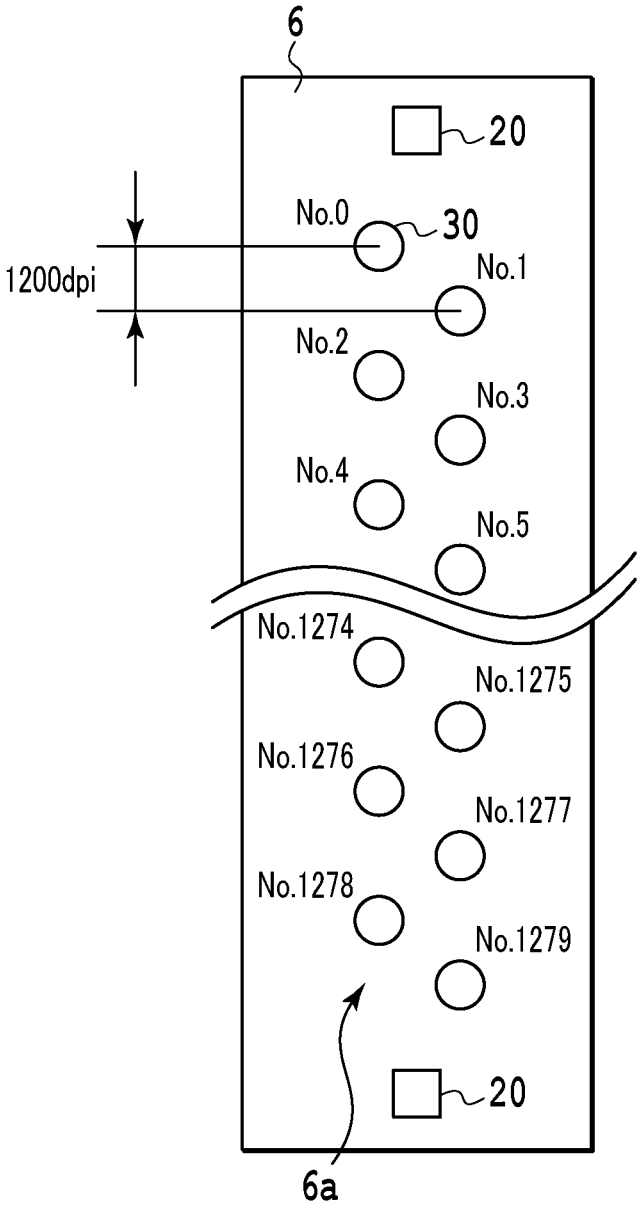
FIG. 3 is a plan view of one of the ejection port formation boards prepared for the print head in FIG. 1B.

FIG. 3 is a plan view of one of the ejection port formation boards 6, for the print head 5, in which the ejection port arrays 6*a* are formed. As shown in FIG. 3, two ejection port arrays 6*a* are formed in each of the ejection port formation boards 6 of the print head 5 that is applied for this embodiment. In this embodiment, 640 ejection ports 30 are formed for each ejection port array 6*a*, and are extended in the sub-scan direction to provide a 1280 ejection port 30 arrangement, wherein the two ejection port arrays 6*a* are shifted away from each other and positioned 1200 dpi (dots per inch) apart.

Figure 4:
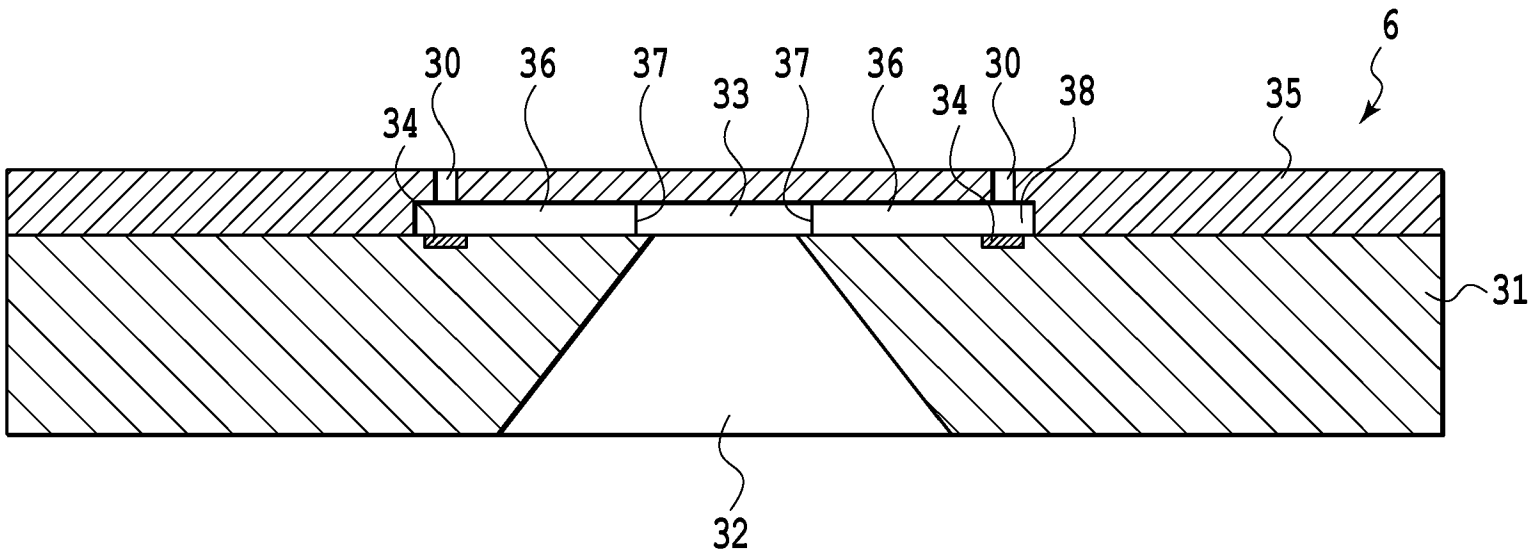
FIG. 4 is a cross sectional view of the ejection port formation board shown in FIG. 3.

FIG. 4 is a schematic cross sectional view of the ejection port formation boards 6 shown in FIG. 3. An upper plate member 35 is mounted on a heat generating element formation board 31 to provide the ejection port formation board 6. A common ink chamber 33 is formed between the heat generating element formation board 31 and the upper plate member 35. The ink supply port 32 communicates with the common ink chamber 33, from which ink flow paths 36 are extended, and communicates with the ejection ports 30 that are formed in the upper plate member 35. Bubble chambers 38 are formed at the ends of the ink flow paths 36 near the ejection ports 30; and in the bubble chambers 38, heat generating elements 34 are located at positions opposite the ejection ports 30. That is, the ink flow paths 36, which communicate with both the ejection ports 30 and the common ink chamber 33, are formed between the upper plate member 35 and the heat generating element formation board 31, and partition walls 37 are formed between the adjacent ink flow paths 36. For the printing operation, the print head driver 25, based on a print signal, drives the heat generating elements 34. And when the heat generating elements 34 are driven, heat is generated by the heat generating elements 34, which heat ink locally, and as a result, film boiling of the ink in the bubble chambers 38 occurs, and the pressure generated at this time forcefully impels ink droplets to be ejected through the ejection ports 30. As is described above, the print head 5 of this embodiment includes the ejection ports 30 and the heat generating elements 34 provided at the flow paths that communicate with the ejection ports 30.

Figure 5A:
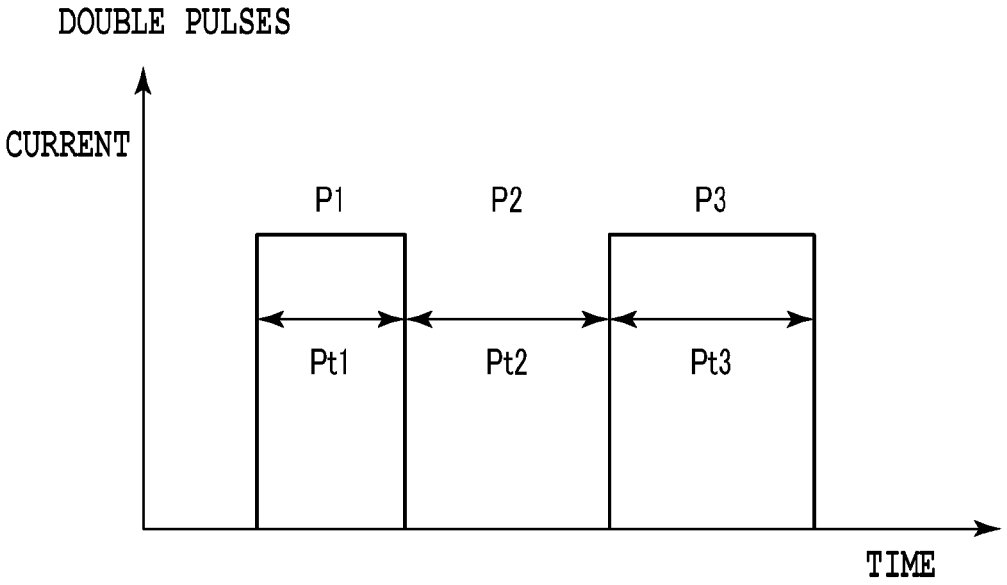
FIGS. 5A and 5B are graphs for explaining periods for driving heat generating elements, respectively by employing double pulses corresponding to FIG. 5A and by employing a single pulse corresponding to FIG. 5B, when the inkjet printing apparatus in FIGS. 1A to 1C performs the ejection of ink.
Figure 5B:
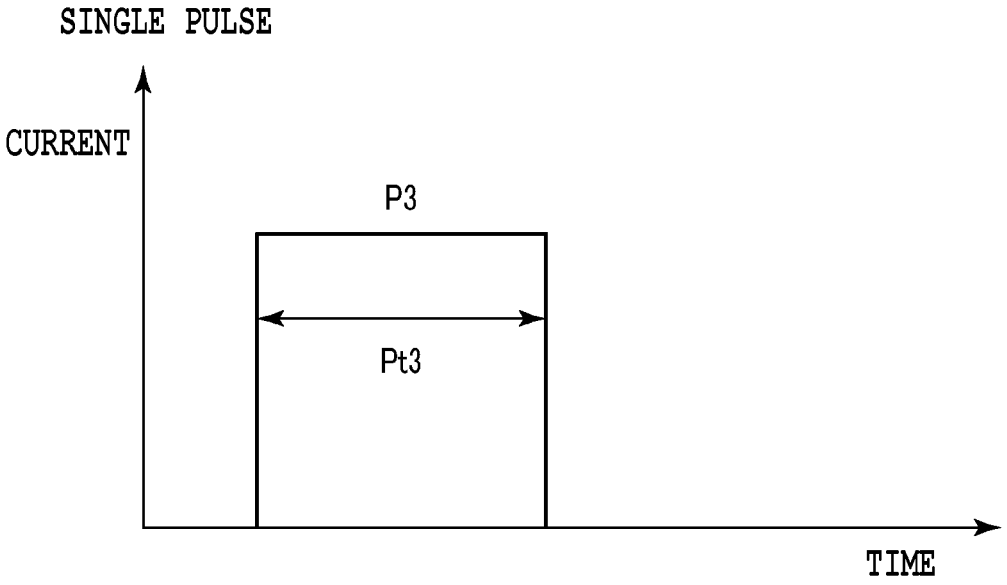

FIGS. 5A and 5B are graphs showing the level of a current that flows across the heat generating elements 34 when they are driven based on a drive signal transmitted by the CPU 200.

As shown in FIG. 5A, the inkjet printing apparatus 100 of this embodiment drives the heat generating elements 34 with a pulse P1, which has a width of a period Pt1, in order to permit the heat generating elements 34 to generate thermal energy that does not cause the ejection of ink droplets. In this case, the pulse P1, which has as a width the period Pt1, is a pulse used to drive the heat generating elements 34 that are not satisfactory for performing the ejection of ink, but that are appropriate for heating ink only around the heat generating elements 34. A pause period P2, having a width of a period Pt2, is set following the pulse P1. After the pause period P2 has elapsed, the heat generating elements 34 are driven by a pulse P3, which has the width of a period Pt3, in order to perform the ejection of ink. As described above, for each ejection of ink droplets, two pulses, the pulse P1, which is not accompanied by the ejection of ink, and the pulse P3, which causes the ejection of ink, are employed to drive the heat generating elements 34, i.e., a so-called double-pulse drive is performed for the ejection of ink.

Since the inkjet printing apparatus 100 of this embodiment performs ink ejection by employing a double-pulse drive, the volume of ink to be ejected can be changed by modulating the pulses P1 and P3. Specifically, when a long period is set for the drive period Pt1 for the pulse P1, the pause period Pt2 and the drive period Pt3 for the pulse P3, the volume of an ink droplet to be ejected can be increased. For an inkjet printing apparatus wherein air bubbles are generated in ink by applying thermal energy using heat generating elements, and the energy generated at this time is employed to eject ink droplets from the ejection ports, the volume of thermal energy applied to ink can be changed by varying the drive periods for pulse signals. When the drive periods using the pulse signals are extended, the thermal energy to be applied to ink is accordingly increased, and the volume of the ink droplets to be ejected is also increased. Especially for this embodiment, when a long period is set for the drive period Pt1 for the pulse P1 and the pause period Pt2, the volume of ink droplets to be ejected can be increased. Further, when a short period is set for the pulse period Pt1 for the pulse P1, the pause period Pt2 and the drive period Pt3 for the pulse P3, the volume of ink to be ejected can be reduced, and especially for this embodiment, when a short period is set for the drive period Pt1 for the pulse P1 and the pause period Pt2, the volume of ink droplets to be ejected can be reduced. Since controlling the volume of ink to be ejected is comparatively easy with the inkjet printing apparatus 100 of this embodiment, the volume of ink to be ejected can be designated to avoid fluctuations in the ejected volume of ink that is affected by a change in the temperature of the print head 5. As described above, according to the inkjet printing apparatus 100 of this embodiment, the heat generating elements 34 is heated by applying a pulse signal, based on the thermal energy generated, to eject ink droplets from the ejection ports 30. For each ejection of ink droplets, a pulse signal (a first pulse signal) that is to be applied previously so as not to be accompanied by the ejection of ink droplets, and a pulse signal (a second pulse signal) that is to be applied subsequently in order to perform the ejection of ink are included as the pulse signals for ejecting ink droplets.

When the temperature of the print head 5 is high and the volume of ejected ink droplets is great, the drive period Pt1 for the pulse P1 and the pause period Pt2 are set as short periods, to reduce the volume of the ink droplets to be ejected. Further, when the temperature of the print head 5 is low and the volume of the ejected ink droplets is reduced, the drive period Pt1 for the pulse P1 and the pause period Pt2 are set as long periods to increase the volume of the ink droplets to be ejected. In this manner, when the temperature of the print head 5 is changed, the drive period Pt1 for the pulse P1 and the pause period Pt2 can be set in accordance with the temperature change, so that a constant volume can be maintained for the ink droplets that are to be ejected. Since the volume of the ink droplets to be ejected is controlled in this manner, printing by ejecting ink droplets having a constant volume can be performed even when the temperature of the print head 5 is changed during printing. Therefore, ink droplets having a constant volume can be ejected for printing an entire image, regardless of temperature changes of the print head 5, and therefore, uniformity in the appearance of the printed image can be appropriately maintained.

Further, the volume of ink to be ejected can be set not only to cope with the temperature changes of the print head 5, but also to suppress errors in the volume of the ink ejected, which occurs due to manufacturing variances in the size of the print head 5. Moreover, the properties of the print head obtained during the course of a shop inspection, e.g., a manufacturing variance in the heat generating element and the nozzle structure, can also be employed to designate the volume of ink droplets to be ejected.

Further, in a case wherein the inkjet printing apparatus includes an ejection threshold value detection device for detecting the minimum pulse width within an ink ejection enabled range, the ejection threshold value detection device is employed to detect, in advance, the minimum pulse width in which the ejection of ink can be performed. At this time, the volume of ink to be ejected by the print head can be set, while taking into account the properties of the print head that are obtained from the detection results obtained by the ejection threshold value detection device.

The inkjet printing apparatus 100 drives the heat generating elements 34 using only one pulse (a single pulse) shown in FIG. 5B to perform ejection of ink droplets. The inkjet printing apparatus 100 employs an optical sensor (not shown) to detect whether or not the ejection of ink has been performed, and gradually reduces the pulse width for a single pulse, employed to drive the heat generating element 34, and detects the minimum pulse width for ejecting ink droplets ejected from the ejection port 30. The minimum pulse width where ink droplets are to be ejected is a unique value for each print head. The inkjet printing apparatus 100 of this embodiment includes such an ejection threshold value detection device that can detect the minimum pulse width for ejecting ink droplets from the ejection port 30.

As described above, for the inkjet printing apparatus 100 of this embodiment, when the heat generating elements 34 are driven by a single pulse, the ejection of ink droplets is enabled from the ejection ports 30. However, the present invention is not limited to this system, and when the minimum pulse width for which ink droplets are to be ejected from the ejection ports is already known and, therefore, need not be detected, ejection of ink may be permitted merely by employing double pulses. In other words, it may not always be required that a single pulse be employed for driving the heat generating elements.

Furthermore, generally, for the inkjet printing apparatus, ejection energy is changed in accordance with the number of heat generating elements (the number of ink droplets simultaneously ejected) that are driven at the same time in a print head. As for the inkjet printing apparatus 100 of this embodiment, a plurality of heat generating elements 34 in the print head 5 can be driven in a time division driving manner to eject ink droplets from the print head 5. Time division driving is a driving method whereby the heat generating elements, which correspond to the 1280 ejection ports shown in FIG. 3, are divided into several groups, and each group of the heat generating elements is driven by shifting the drive timing among the groups, while ink is ejected at the same time from the ejection ports that belong to the same group. That is, instead of driving all of the heat generating elements 34 of the print head 5, the heat generating elements 34 for each group are driven at the same time. Since the inkjet printing apparatus 100 employs the time-division drive method described above, the number of heat generating elements 34 to be driven at the same time can be reduced. Therefore, an excessive increase in the consumption of power used for driving the heat generating elements 34 at one time, can be suppressed.

Figure 6:
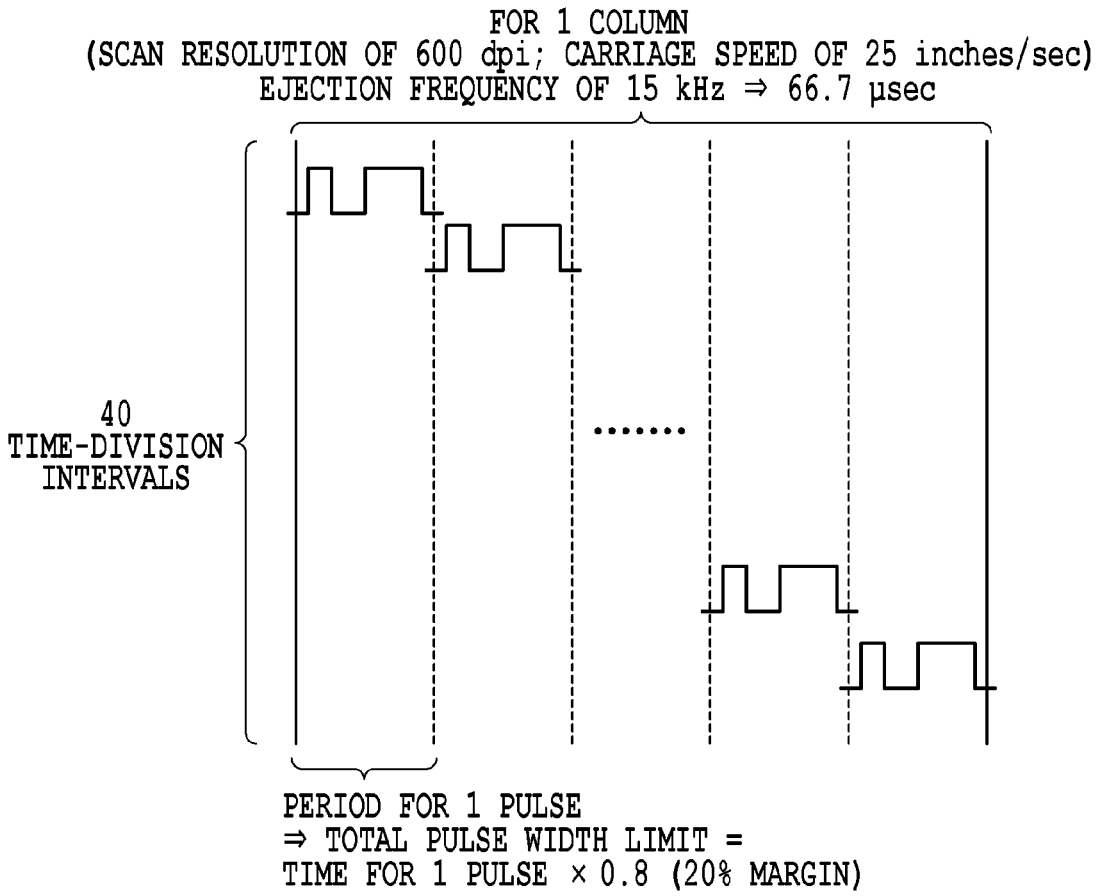
FIG. 6 is a diagram for explaining individual pulse drive periods for the heat generating elements when the inkjet printing apparatus in FIGS. 1A to 1C performs printing by a time division driving method.

FIG. 6 is a diagram showing the timings at which pulse signals are applied to 40 groups of heat generating elements 34 that are to be driven, in the time-division manner, in order to print image data for one column (a resolution in the main scan direction of 1200 dots per inch, and a carriage speed of 25 inches per second). The pulse signals for driving the individual heat generating elements 34 are transmitted to the control circuit of the print head 5 in a serial manner, and are sorted for the individual groups and applied to the heat generating elements 34 of the corresponding groups. That is, a period required for driving one heat generating element 34 is equivalent to a period required for transferring, to one of the groups obtained for time-division drive, a signal used to drive all the heat generating elements 34 that belong to the group. Therefore, the drive pulse is designed so that the total of the pulse widths of the drive signals applied to all of the groups should not exceed an upper limit value that is determined by the drive frequency, the number of groups driven in a time division and a margin. Since the example in FIG. 6 shows an ejection frequency of 15 kHz and the number of groups, in a time division of 40 and having a margin of 20%, the upper limit value of the total pulse width for each heat generating element 34 is 1.330 μsec.

In this embodiment, since time-division drive is employed for driving the heat generating elements 34, a plurality of heat generating elements 34 are to be driven at the same time. At this time, when an increased number of heat generating elements 34 are driven at the same time, a voltage drop is reduced for each of the heat generating elements 34 that are to be driven. Therefore, the ejection energy may be reduced, and accordingly, the volume of ink to be ejected may be lowered. However, in this case, the volume of ink droplets to be ejected can be adjusted to compensate for the reduction in the ejection energy by control of the drive period Pt1, for the pulse P1, the pause period Pt2 and the drive period Pt3, for the pulse P3, for a double-pulse drive. In this embodiment, the length of the drive period Pt3 of the pulse P3 can be adjusted to compensate for the change in the ejection energy.

(Pulse Width Adjustment)

For the inkjet printing apparatus 100 of this embodiment, the drive period for a drive pulse is determined based on the temperature of the print head 5 and the property of the print head 5. Further, the pulse width control is performed in order to compensate for the fluctuation in the value of the ejection energy that is changed when the print head 5 is operated by employing time-division driving. In this embodiment, in a case wherein the total of the pulse widths exceeds the limit of the total pulse width that has been determined in advance, the individual pulse widths are controlled so as to fit within the total pulse width range.

Figure 7:
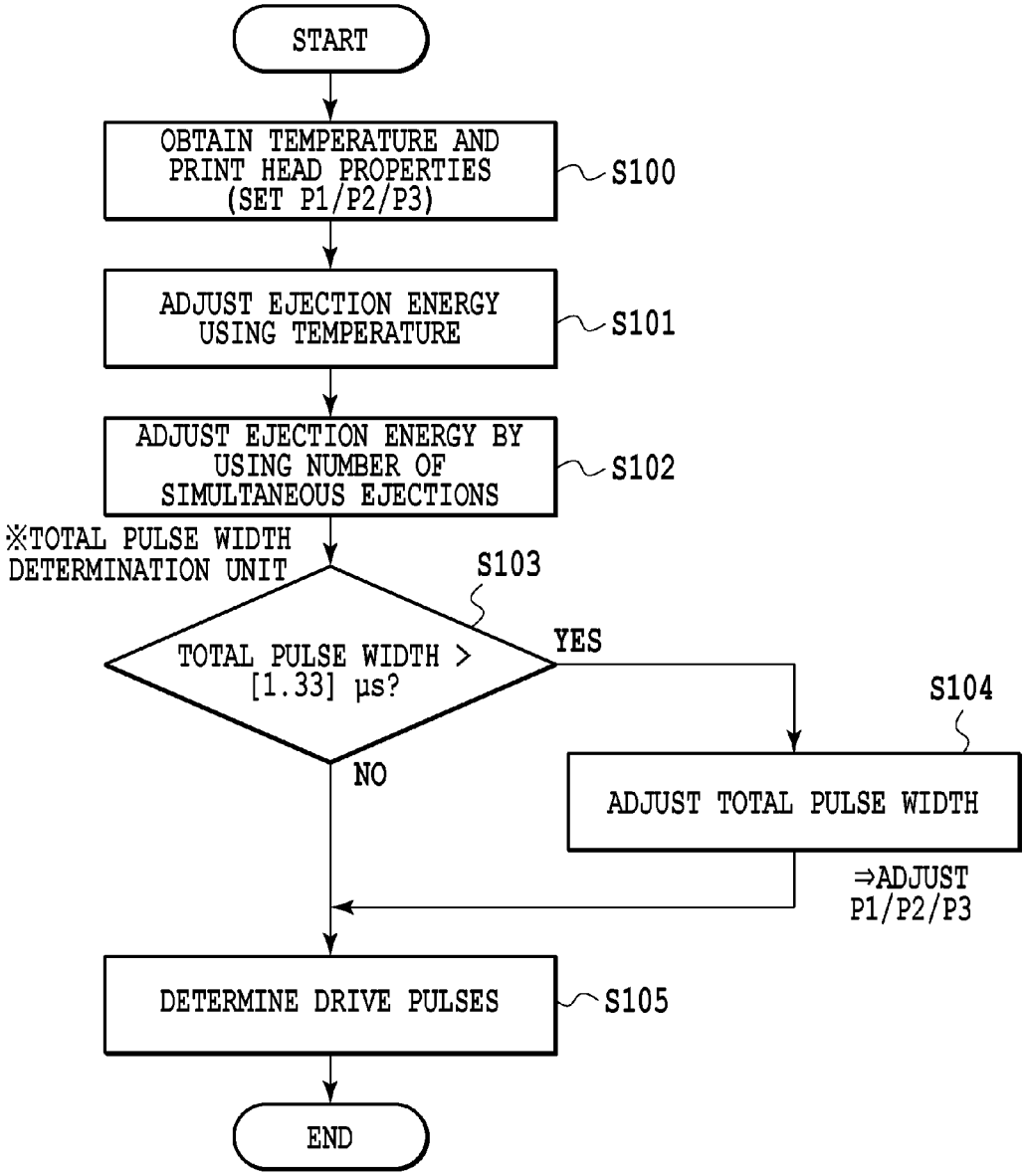
FIG. 7 is a flowchart showing the processing performed by the inkjet printing apparatus in FIGS. 1A to 1C for adjusting a drive period for a pulse driven previously, a pause period and a drive period for a pulse driven subsequently in order to drive the heat generating elements by employing double pulses.

FIG. 7 is a flowchart showing the sequence of a drive pulse determination process, including the adjustment of the total pulse width. First, at S100, the temperature of the print head 5 and the property of the print head 5 are obtained. The temperature of the print head 5 and the property of the print head 5 are employed to set the drive period P1 of the previous pulse, the pause period P2 and the drive period P3 of the subsequent pulse, for double-pulse drive. The property of the print head 5 in this case is the characteristics of the heat generating elements 34 and the nozzle structure, which are obtained at the shop inspection, or the print head characteristics that are related to the results obtained by the ejection threshold detection device that detects the minimum pulse width, for which ejection is enabled. At S101 and S102 in FIG. 7, the drive period P3 of the pulse driven subsequently for the double-pulse drive is adjusted in order to compensate for the fluctuation of ejection energy that is caused by the change of the temperature or the change of the number of ink droplets ejected at one time. As described above, in this embodiment, the previous pulse drive period P1 (first pulse signal drive period), the subsequent pulse drive period P3 (second pulse signal drive period) and the pause period P2 are set in order to provide one ejection performance of ink droplets. At this time, the CPU 200 serves as a setup unit for setting the pulse drive period P1 driven previously, the pause period P2 and the pulse drive period P3 driven subsequently.

Thereafter, at S103, a total pulse width determination unit determines whether the total pulse width is greater than the upper limit (threshold value) for the total pulse width. In this embodiment, the upper limit of the total pulse width for each heat generating element 34 is set as 1.330 μsec. That is, in this embodiment, a check is performed to determine whether the ejection period, which is the total of the pulse drive period P1 driven previously, the pulse drive period P3 driven subsequently and the pause period P2 that have been set, is greater than a threshold value designated in advance for the ejection period. In this embodiment, the CPU 200 serves as a determination unit for determining whether the ejection period is greater than the threshold value designated in advance for the ejection period.

When the total pulse width is not greater than the upper limit value, the pulse drive period P1 driven previously, the pause period P2 and the second pulse drive period P3 driven subsequently, which have been determined, are employed.

Figure 8:
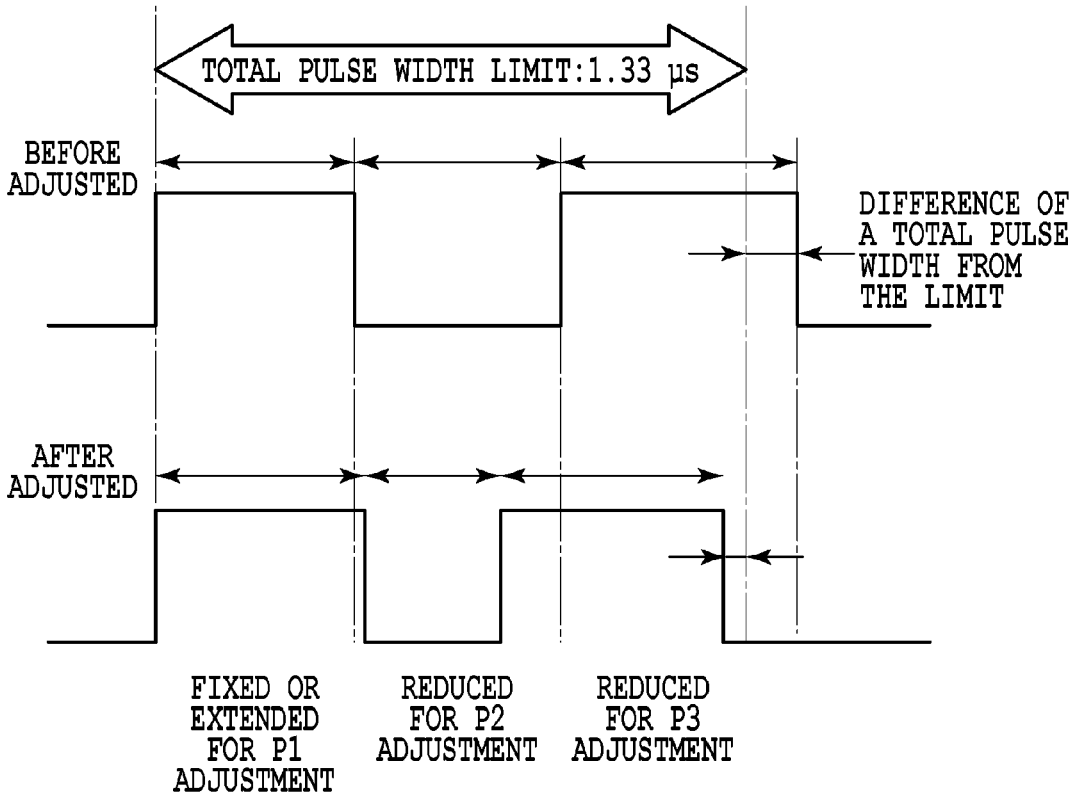
FIG. 8 is a diagram for explaining the pulse drive period for driving previously, the pause period and the pulse drive period for driving subsequently, when adjustment of respective pulse drive period and pause period is performed in the inkjet printing apparatus in FIGS. 1A to 1C.

When the total pulse width is greater than the upper limit value, program control advances to S104, whereat the previous pulse drive period P1, the pause period P2 and the subsequent pulse drive period P3 are adjusted in order to fit within the total pulse width limit. In order to minimize the affect on an image, the individual pulse widths P1, P2 and P3 are adjusted, so that the volume of ink ejected is near the volume provided using the pulses, before being adjusted. Therefore, as shown in FIG. 8, it is preferable that the total pulse width is adjusted so that the pause period P2 and the subsequent pulse drive period P3 is shortened and the previous pulse drive period P1 is kept or increased, in order to fit within the limit for the total pulse width. As described above, in this embodiment, when the total pulse width (the ejection period) is greater than the upper limit, the total pulse width is adjusted, so that the subsequent pulse drive period P3 and the pause period P2 is shortened, so as to be equal to or lower than the threshold value. In this embodiment, the CPU 200 serves as an adjustment unit for adjusting the total pulse width.

When the heat generating elements 34 are driven by using double pulses, the volume of ink to be ejected can be changed by modulating the previous pulse drive period P1. In a case wherein the previous pulse drive period P1 is changed, the change in the volume of ink to be ejected is comparatively great.

Figure 9A:
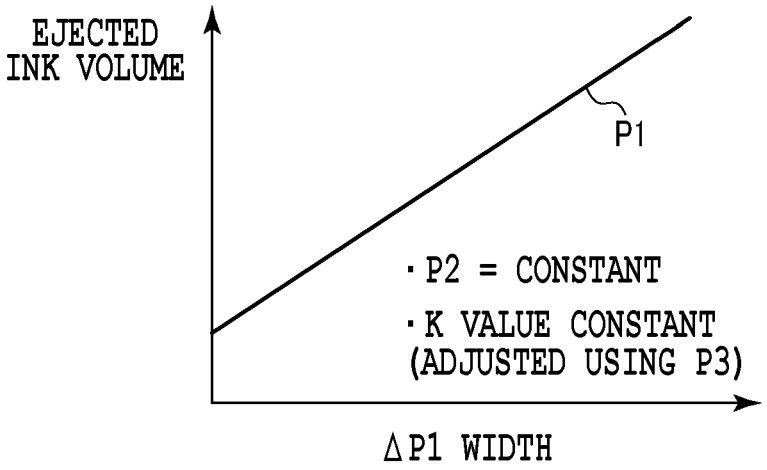
FIG. 9A is a graph showing a change in the volume of ink ejected by the inkjet printing apparatus in FIGS. 1A to 1C when the previous pulse drive period was changed.
Figure 9B:
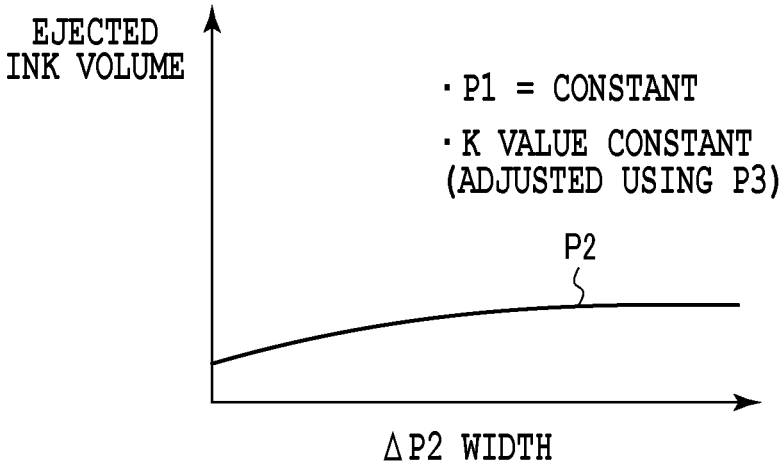
FIG. 9B is a graph showing a change in the volume of ink ejected when the pause period was changed.

FIG. 9A is a graph showing a change in the volume of ink ejected when the drive period P1 for the previous pulse was changed, while the constant pause period P2 was maintained. FIG. 9B is a graph showing the change in the volume of ink ejected when the pause period P2 was changed, while the constant drive period P1 for the previous pulse was maintained. As shown in the graphs in FIGS. 9A and 9B, the change in the volume of ink ejected, with respect to the change in the length of the pause period P2, is much smaller than the change in the volume of ink ejected, with respect to the change in the length of the previous pulse drive period P1. That is, when the length of the pause period P2 is comparatively greatly changed, the volume of the ink droplets ejected is not greatly changed. Therefore, reducing the length of the pause period P2 is preferable when the total pulse width is being changed, i.e., the period required to perform the ejection of ink droplets one time, while suppressing the change in the volume of ink droplets ejected as much as possible. As a result, the reduction in the volume of the ejected ink droplets can be suppressed as much as possible, and in addition, the total pulse width, i.e., the pulse drive period required to drive the heat generating elements, can be reduced.

Further, when the pause period P2 is reduced, this more or less affects the volume of ink droplets ejected, which is also a little reduced. Therefore, the reduction in the volume of ink droplets ejected, which is caused by reducing the pause period P2, must be compensated for. In this embodiment, the drive period P1 for the previous pulse is extended to compensate for the reduction in the volume of ink droplets ejected that is caused by reducing the pause period P2. In a case wherein the drive period P1 for the previous pulse is changed even a little, comparatively, the volume of the ink droplets ejected is greatly changed. Thus, when the length of the pulse drive period P1 is changed a little, a comparatively great change can be provided for the volume of the ink droplets. As a result, comparatively, the volume of the ink droplets to be ejected can be greatly changed, while the total pulse drive period is changed only a little. In this embodiment, the ejection period is adjusted to increase the previous pulse drive period P1.

Since the change in the volume of ink ejected is comparatively small, due to the reduction in the length of the pause period P2, the previous pulse drive period P1 may be set as a fixed period, so long as only a change so small that it may be ignored is caused in the volume of the ejected ink by reducing the pause period P2.

Furthermore, it is preferable that fluctuation of the energy employed to eject ink droplets is suppressed between before the drive pulses being adjusted and after being adjusted. This is because when the value of the energy employed for the ejection of ink droplets differs greatly before and after the pulse drive period has been adjusted, this will adversely affect the service life of the heat generating element 34. In this embodiment, for the pulse adjustment, the length of the subsequent pulse drive period P3 is reduced in order to suppress the energy fluctuation employed for the ejection of ink droplets. At this time, the service life of the heat generating element 34 indicates a period continuing until this function is lost by the heat generating element 34. When the heat generating element 34 has been employed for a long time, there is a possibility that the heat generating element 34 will be worn out by shocks caused by driving the heat generating element 34 to generate heat, or when bubbles were formed, or disappeared, and the strength of the protective film of the heat generating element 34 was reduced. Further, there is a possibility that the function of the insulating layer will be damaged, and that a short circuit may occur between the electrical wiring portion in the heat generating element 34 and ink, to cause the function of the heat generating element 34 to be lost.

As described above, control of the pulse width in this embodiment is performed at S104, in the processing described in FIG. 7. The adjustment of the pulse width is performed by referring to a pulse width adjustment table shown in FIG. 10, which is stored in the memory, ROM 201. In this embodiment, the pulse width adjustment table is prepared for each predetermined interval for the pulse drive period P1 of the previous pulse to be driven.

Adjustment values for the previous pulse drive period P1, the pause period P2 and the subsequent pulse drive period P3 are selected based on the amount, exceeding the upper limit, of the total pulse width that is obtained by adding together the previous pulse drive period P1, the pause period P2 and the subsequent pulse drive period P3, which have been acquired at S100 to S102. The adjustment values selected from the table for the periods P1, P2 and P3 are employed to obtain new periods P1, P2 and P3, and drive pulses to be applied to the heat generating elements 34 are finally set. At this time, as described above, based on the excess value, the adjustment values for the periods P1, P2 and P3 are selected from the pulse width adjustment table, so that shortened periods P2 and P3 are set and either a fixed or extended period P1 is set so that the total pulse width does not exceed the designated limit. Further, the periods P1, P2 and P3 are set so that before and after the adjustment of the pulse width has been performed, there is a comparatively small difference in the value of the energy employed for the ejection of ink droplets. In this embodiment, a plurality of sets, each consisting of adjustment values of the previous pulse drive period P1, the subsequent pulse drive period P3 and the pause period P2, are prepared for the table. Based on the previous pulse drive period P1 that is designated and the amount of the total pulse width exceeding the upper limit value, a set of the adjustment values for the previous pulse drive period P1, the pause period P2 and the subsequent pulse drive period P3 is selected. The selected adjustment values are then employed to adjust the previous pulse drive period P1, the pause period P2 and the subsequent pulse drive period P3.

This process will be described by employing a case wherein, for example, P1=0.380 μsec, P2=0.500 μsec and P3=0.480 μsec are set at S102.

The total pulse width of P1, P2 and P3 is 1.360 μsec, and the upper limit value of the total pulse width in this embodiment is 1.330 μsec. Therefore, the amount exceeding the upper limit value for the total pulse width of P1, P2 and P3 obtained at S102 is 0.030 μsec. Then, since the total pulse width of the P1, P2 and P3 obtained at S102 exceeds the upper limit value, correction values relative to the setup values P1, P2 and P3 are selected from tables shown in FIG. 10.

Since the value of P1 obtained at S102 is 0.380 μsec, a table for 0.3 μsec≤P1<0.4 μsec is selected from among a group of tables shown in FIG. 10. Further, since a value x, exceeding the upper limit value, of the total pulse width is 0.030 μsec, a row of 0.024<x≤0.032 (μsec) is chosen from the table that has been selected. Based on the pulse width adjustment table thus selected, +0.004 μsec is obtained as the P1 adjustment value, −0.029 μsec is obtained as the P2 adjustment value, and −0.008 μsec is obtained as the P3 adjustment value. Therefore, when these adjustment values and the values of P1, P2 and P3 previously obtained at S102 are employed, drive pulses to be applied to the heat generating element are finally set as P1=0.384 μsec, P2=0.471 μsec, and P3=0.472 μsec.

As shown in FIG. 10, when the total pulse width of P1, P2 and P3 is greater than the upper limit value, P1 is adjusted by being increased, and P2 and P3 are adjusted by being decreased, from the table. In a case such as in this embodiment, wherein it is ascertained whether the total pulse width is greater than the upper limit value or not, and when the total pulse width is greater than the upper limit value, the individual periods P1, P2 and P3 are adjusted so that the periods P2 and P3 are reduced, while the period P1 is fixed or increased, based on the excess amount. Since the individual periods P1, P2 and P3 are set in this manner, the total pulse width is controlled so as to fit within the range limit, and the fluctuation in the volume of the ejected ink droplets is reduced.

As described above, according to this embodiment, the fluctuation of the amount of ejected ink droplets can be reduced, and the period required for ejection of ink droplets can also be fitted within a predetermined period of time. Since the fluctuation of ejected ink droplets can be suppressed for reducing the period required for ejection of ink droplets, a high quality of a printed image can be maintained. Furthermore, since the period required for ejection of ink droplets can be reduced, while the high quality of a printed image is maintained, the printing speed can be increased, and the printing efficiency can be improved.

Second Embodiment

A second embodiment for carrying out the present invention will now be described. No description will be given for the same arrangement as for the first embodiment, and only the different portion will be described.

Figure 11:
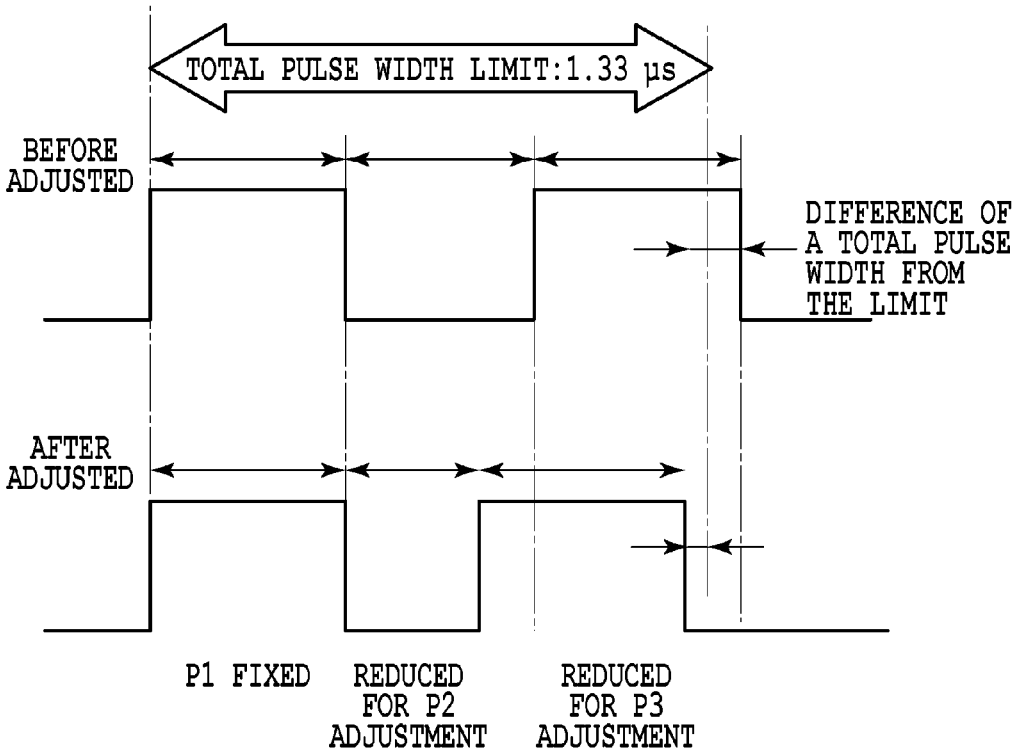
FIG. 11 is a diagram for explaining a drive period for a pulse driven previously, a pause period and a pulse drive period for a pulse driven subsequently, when adjustment of respective pulse drive period and pause period is performed in an inkjet printing apparatus according to a second embodiment of the present invention.

An inkjet printing apparatus for the second embodiment is a system for which the adjustment process for the periods P1, P2 and P3 performed by the inkjet printing apparatus of the first embodiment is simplified, and the number of data sets entered in each table employed for pulse width adjustment is reduced. Specifically, in this embodiment, as shown in FIG. 11, the period P1 is fixed, and the lengths of the periods P2 and P3 are reduced to adjust the total pulse width.

As described for the first embodiment, the fluctuation of the drive period P1 for the previous pulse has comparatively large affect for the volume of ejected ink. On the other hand, when the pause period P2 and the drive period P3 for the subsequent pulse are changed, the volume of ejected ink is not much changed. Therefore, in the second embodiment, the drive period P1 for the previous pulse is unchanged, while the pause period P2 and the drive period P3 for the subsequent pulse are changed, so that the total pulse drive period is adjusted, while the volume of ejected ink is changed as little as possible. Since the drive pulse P1 for the previous pulse is maintained unchanged, the control process can be simplified compared with the process in the first embodiment. As described above, in the second embodiment, for adjustment of the total pulse width, the drive period P1 for the previous pulse is fixed.

Figure 12:
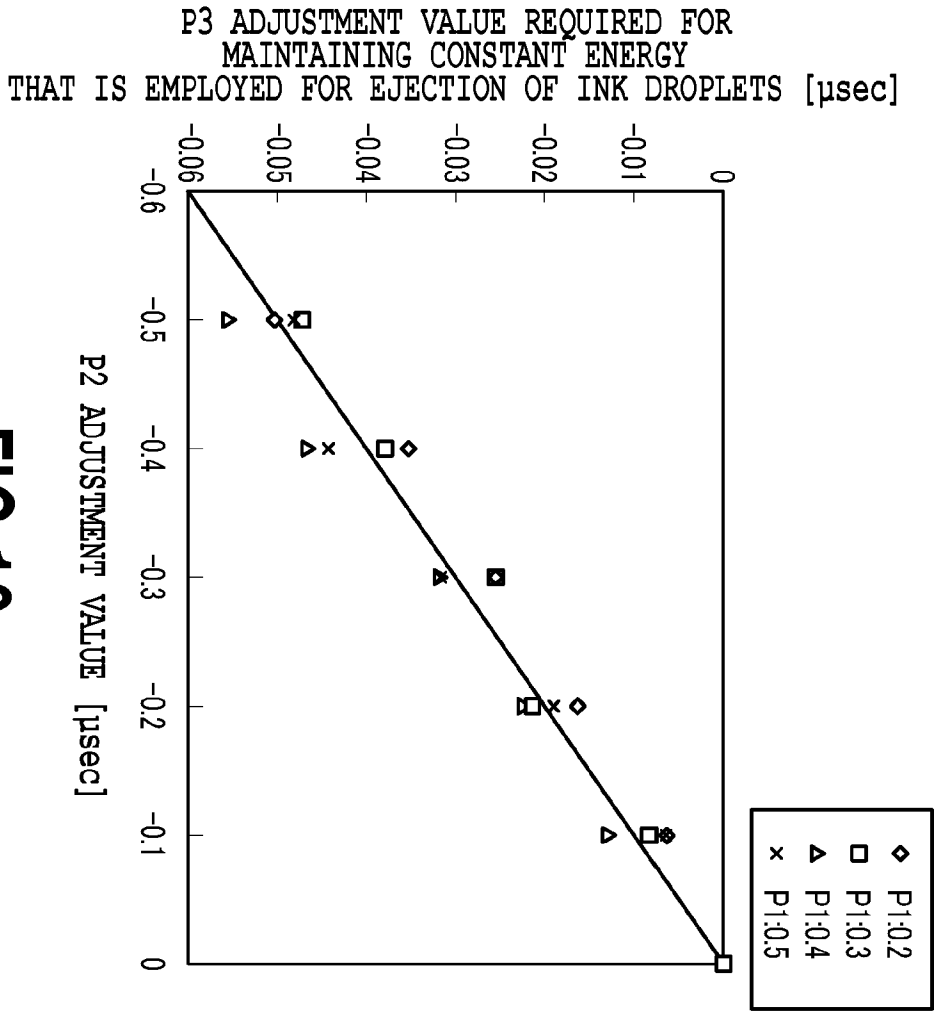
FIG. 12 is a diagram for explaining a relationship between the pause period and the pulse drive period driven subsequently when the inkjet printing apparatus of the second embodiment of the present invention performs adjustments for the individual pulse drive periods and the pause period.

FIG. 12 is a graph showing a relationship between the P2 adjustment value and the P3 adjustment value in a case wherein the lengths of the P1, P2 and P3 are to be adjusted in order to maintain constant ejection energy that is employed to eject ink droplets. As shown in FIG. 12, when the P2 is changed, it is found that the same P3 adjustment value is employed, regardless of the value of P1, in order to maintain the constant energy employed for ejection of ink droplets. That is, a ratio of the P2 adjustment value to the P3 adjustment value, both of which are employed to control the total pulse width, does not depend on the pulse width of P1. Thus, the pulse width adjustment table to be examined at S104 need not be prepared for each value of P1. Therefore, as shown in FIG. 13, only a table wherein data for the P2 and P3 adjustment values are prepared is required. As described above, in this embodiment, a plurality of data sets, each indicating a set of adjustment values for the drive period P3 for the subsequent pulse and the pause period P2, are prepared. Then, based on the amount, exceeding the upper limit value, of the total pulse width that is set, a set of adjustment values for the subsequent pulse drive period P3 and the pause period P2 is selected. These selected adjustment values are employed to control the period P3 for the subsequent pulse and the pause period P2. According to the second embodiment, a volume of data to be stored in the memory can be reduced more than the volume by the method of the first embodiment. Since the memory capacity can be reduced, the inkjet printing apparatus can be manufactured at a lower cost.

An example pulse adjustment process employing this method will now be described. For this process, assume that, for example, P1=0.380 μsec, P2=0.500 μsec, and P3=0.480 μsec have been set at S102. In this case, the total pulse width of drive pulses accompanied by ejection of ink droplets one-time is 1.360 μsec, and since the upper limit value of the total pulse width for this embodiment is 1.330 μsec, the amount of the total pulse width exceeding the upper limit value is 0.030 μsec. Therefore, from a table shown in FIG. 13, a row of $0.024<x\leq0.032$ is selected. By referring to the pulse width adjustment table in FIG. 13, the adjustment value for the paused period P2 is −0.029 μsec, and the adjustment value for the drive period P3 for the subsequent pulse is −0.003 μsec. The adjusted drive pulses to be applied to the heat generating elements are P1=0.380 μsec, P2=0.471 μsec, and P3=0.477 μsec.

Third Embodiment

A third embodiment for carrying out the present invention will now be described. No description will be given for the same arrangement as for the first and the second embodiments, and only the different portion will be described.

For the third embodiment, the arrangement for performing adjustment of pulse drive periods is more simplified than the arrangements provided for the first and second embodiments. In the third embodiment, instead of employing a table for the pulse width adjustment, a method for calculating an adjustment value for a pause period P2 and an adjustment value for a drive period P3 for the subsequent pulse is employed.

It is known that, as shown in FIG. 12, a linear relationship is established between the adjustment value for the pause period P2 and the adjustment value for the drive period P3 for the subsequent pulse in order to maintain the constant energy that is employed for ejection of ink droplets.

Therefore, a ratio of the P2 adjustment value and the P3 adjustment value is always constant, and at S104 in the processing in FIG. 7, the adjustment value for P2 and the adjustment value P3 can be obtained by calculation. In this embodiment, a ratio of the P2 adjustment value to the P3 adjustment value is 10:1.

Therefore, the P2 adjustment value and the P3 adjustment value can be obtained by calculating expressions (1) and (2) below.

$$P2 \text{ adjustment value} = -(\text{excess amount}) \times 10/11 \quad (1)$$

$$P3 \text{ adjustment value} = -(\text{excess amount})/11 \quad (2)$$

A pulse adjustment process performed by employing this method will now be described. For this process, assume that, for example, P1=0.380 μsec, P2=0.500 μsec, and P3=0.480 μsec have been set at S102. In this case, the total pulse width of drive pulses accompanied by ejection of ink droplets one time is 1.360 μsec, and since the upper limit value of the total pulse width for this embodiment is 1.330 μsec, the amount of the total pulse width exceeding the upper limit value is 0.030 μsec.

Therefore, based on expressions (1) and (2) above, the adjustment value for the pause period P2 is −0.027 μsec, and the adjustment value for the drive period P3 for the subsequent pulse is −0.003 μsec. As a result, P1=0.380 μsec, P2=0.473 μsec and P3=0.477 μsec are finally obtained as drive pulses to be applied to heat generating elements.

As described above, in this embodiment, a constant ratio is established for the adjustment value for the pause period P2 and the adjustment value for the drive period P3 for the subsequent pulse. Further, the adjustment value for the pause period P2 and the adjustment value for the drive period P3 for the subsequent pulse are obtained by calculation, and the obtained adjustment values are employed to adjust the pause period P2 and the drive period P3 for the subsequent pulse.

According to the method of the third embodiment to adjust the pulse drive periods, data for the adjustment values of the individual periods need not be stored as a table to perform the adjustment of pulse drive periods. Therefore, the memory capacity of the ROM 201 can be reduced more, and the manufacturing cost for the inkjet printing apparatus can be lowered more.

Fourth Embodiment

A fourth embodiment for carrying out the present invention will now be described. No description will be given for the same arrangement as for the first to the third embodiments, and only the different portion will be described.

The upper limit value of the total pulse width that is obtained by adding a drive period P1 for a previous pulse, a pause period P2 and a drive period P3 for a subsequent pulse, all of which are required for performing ejection of ink droplets one time, is determined, depending on a time period required for printing for one column, which is a reciprocal number of an ejection frequency, and the number of intervals in time division.

In the printing operation of an inkjet printing apparatus for this embodiment, the main scan speed of a carriage and an ejection frequency are changed in accordance with a printing mode. In such a case, the upper limit value for the total pulse width is also changed. In this case, the upper limit value of the total pulse width is greater when the ejection frequency is lower (main scan speed is lower), and therefore, longer periods P1 and P3 can be employed for a printing mode with a low ejection frequency. Thus, in this embodiment, in a case wherein the upper limit value of the total pulse width is changed in accordance with the printing mode, the upper limit value of the total pulse width, which is employed at S103 to determine whether the total pulse width exceeds the upper limit value, is changed in accordance with the printing mode, as shown in FIG. 14. As described above, in this embodiment, the upper limit value of the total pulse width is changed in accordance with the ejection frequency.

In a case as in the embodiment, wherein the upper limit value of the total pulse width is changed based on the printing mode, it is preferable that the upper limit value of the total pulse width is set in accordance with the printing mode provided by the inkjet printing apparatus. When the upper limit value of the total pulse width is changed for each printing mode, the drive pulses can be selected, for each printing mode, within the upper limit value of the total pulse with.

In the following description, "printing" represents not only a case wherein significant information, such as characters and figures, are formed, and but also includes a case wherein an image, a design or a pattern is formed on a printing medium, regardless of whether information is significant or not, or regardless of whether the information is visually presented so as to be recognized by a person, and a case wherein the processing for a printing medium is performed.

Moreover, a "printing apparatus" includes an apparatus having a printing function, such as a printer, a multifunctional printer, a copier or a facsimile machine, and a manufacturing apparatus that employs the inkjet technology to produce goods.

Further, a "printing medium" represents not only paper employed for a general printing apparatus, but also includes a variety of materials, such as cloth, plastic film, metal sheets, glass, ceramics, a wood material and leather, that can accept ink.

Furthermore, the definition of "ink" (also called a "liquid") should be widely interpreted in the same manner as the definition of "printing". That is, ink represents a liquid that is applied to a printing medium in order to form an image, a design or a pattern, or to process the printing medium, or to perform treating of ink (for example, coagulating or insolubilizing of the coloring material of ink to be applied to a printing medium).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-049196, filed Mar. 6, 2012, which is hereby incorporated by reference herein in its entirety.

What is claimed is:

1. An inkjet printing apparatus comprising:

a print head having an element array in which a plurality of printing elements are arranged in an arranging direction;

a first obtaining unit configured to obtain a first driving pulse comprising a prepulse that is applied to the printing element, and a main pulse that is applied to the printing element after applying the repulse based on at least a temperature of the print head;

a first determining unit configured to determine a second driving pulse comprising the prepulse and the main pulse by adjusting at least a period of the main pulse of the first driving pulse obtained by the first obtaining unit;

a second obtaining unit configured to obtain information regarding a total period comprising a period of the repulse of the second driving pulse, a period of the main pulse of the second driving pulse, and a pause period between the repulse of the second driving pulse and the main pulse of the second driving pulse;

a second determining unit configured to determine a third driving pulse comprising the prepulse and the main pulse based on the second driving pulse determined by the first determining unit; and a controlling unit configured to control ejecting ink from the print head by applying the third driving pulse determined by the second determining unit to the printing elements, wherein the second determining unit determines the third driving pulse, when the total period indicated by the information obtained by the second obtaining unit is higher than a threshold value, by adjusting at least a period of the main pulse of the second driving pulse and the pause period of the second driving pulse based on a difference between the total period indicated by the information obtained by the second obtaining unit and the threshold value such that a total period of the third driving pulse determined by the second determining unit is equal to or lower than the threshold value.

2. The inkjet printing apparatus according to claim 1, wherein the second determining unit determines the third driving pulse, (i) in a case that the total period indicated by the information obtained by the second obtaining unit is higher than the threshold value and the difference between the total period indicated by the information obtained by the second obtaining unit and the threshold value is a first value, by adjusting the period of the main pulse of the second driving pulse so as to shorten the period of the main pulse of the second driving pulse by a first adjustment value, and (ii) in a case that the total period indicated by the information obtained by the second obtaining unit is higher than the threshold value and the difference between the total period indicated by the information obtained by the second obtaining unit and the threshold value is a second value which is higher than the first value, by adjusting the period of the main pulse of the second driving pulse so as to shorten the period of the main pulse of the second driving pulse by a second adjustment value which is higher than the first adjustment value.

3. The inkjet printing apparatus according to claim 2, wherein the second determining unit determines the third driving pulse, (i) in a case that the total period indicated by the information obtained by the second obtaining unit is higher than the threshold value and the difference between the total period indicated by the information obtained by the second obtaining unit and the threshold value is the first value, by adjusting the pause period of the second driving pulse so as to shorten the pause period of the second driving pulse by a third adjustment value, and (ii) in a case that the total period indicated by the information obtained by the second obtaining unit is higher than the threshold value and the difference between the total period and indicated by the information obtained by the second obtaining unit the threshold value is the second value, by adjusting the pause period of the second driving pulse so as to shorten the pause period of the second driving pulse by a fourth adjustment value which is higher than the third adjustment value.

4. The inkjet printing apparatus according to claim 3, further comprising:

a memory configured to memorize a table that defines a plurality of adjustment values, at least including the first adjustment value and the second adjusting value, for the period of the main pulse and a plurality of adjustment values, at least including the third adjustment value and the fourth adjusting value, for the pause period, in accordance with the difference between the total period and the threshold value, wherein the determining unit determines the third driving pulse, in a case that the total period indicated by the information obtained by the second obtaining unit is higher than a threshold value, by adjusting the period of the main pulse of the second driving pulse and the pause period of the second driving pulse by using the table memorized by the memory.

5. The inkjet printing apparatus according to claim 3, wherein the second determining unit determines the third driving pulse by not adjusting the period of the prepulse of the second driving pulse when the total period indicated by the information obtained by the second obtaining unit is higher than the threshold value.

6. The inkjet printing apparatus according to claim 3, wherein a ratio of the third adjustment value and the first adjustment value is substantially equal to a ratio of the fourth adjustment value and the second adjustment value.

7. The inkjet printing apparatus according to claim 3, wherein the second determining unit determines the third driving pulse, (i) in a case that the total period indicated by the information obtained by the second obtaining unit is higher than the threshold value and the difference between the total period indicated by the information obtained by the second obtaining unit and the threshold value is the first value, by adjusting the period of the prepulse of the second driving pulse so as to lengthen the period of the prepulse of the second driving pulse by a fifth adjustment value, and (ii) in a case that the total period indicated by the information obtained by the second obtaining unit is higher than the threshold value and the difference between the total period indicated by the information obtained by the second obtaining unit and the threshold value is the second value, by adjusting the period of the prepulse of the second driving pulse so as to lengthen the period of the prepulse of the second driving pulse by a sixth adjustment value which is higher than the fifth adjustment value.

8. The inkjet printing apparatus according to claim 7, further comprising:

a memory configured to memorize a table that defines a plurality of adjustment values, at least including the first adjustment value and the second adjusting value, for the period of the main pulse, a plurality of adjustment values, at least including the third adjustment value and the fourth adjusting value, for the pause period, and a plurality of adjustment values, at least including the fifth adjustment value and the sixth adjusting value, for the period of the prepulse, in accordance with the difference between the total period and the threshold value, wherein the determining unit determines the third driving pulse, in a case that the total period indicated by the information obtained by the second obtaining unit is higher than a threshold value, by adjusting the period of the main pulse of the second driving pulse and the pause period of the second driving pulse by using the table memorized by the memory.

9. The inkjet printing apparatus according to claim 1, wherein the first determining unit determines the second driving pulse by adjusting at least a period of the main pulse of the first driving pulse obtained by the first obtaining unit based on a temperature of the print head.

10. The inkjet printing apparatus according to claim 1, wherein the first determining unit determines the second driving pulse by adjusting at least a period of the main pulse of the first driving pulse obtained by the first obtaining unit based on a number of simultaneous ejections.

11. The inkjet printing apparatus according to claim 1, further comprising:

a third obtaining unit configured to obtain information regarding the threshold value based on an ejection frequency.

12. The inkjet printing apparatus according to claim 11, wherein (i) in a case that the ejection frequency is a first frequency, the threshold value indicated by the information obtained by the third obtaining unit is a first threshold value, and (ii) in a case that the ejection frequency is a second frequency which is lower than the first frequency, the threshold value indicated by the information obtained by the third obtaining unit is a second threshold value which is higher than the first threshold value.

13. The inkjet printing apparatus according to claim 1, wherein the second determining unit determines the third driving pulse by not adjusting the period of the main pulse of the second driving pulse, the pause period of the second driving pulse, and the period of prepulse of the second driving pulse when the total period indicated by the information obtained by the second obtaining unit is lower than or equal to the threshold value.

14. The inkjet printing apparatus according to claim 1, wherein the first determining unit determines the second driving pulse for suppressing a fluctuation of ejection energy.

15. An inkjet printing method for printing an image by using a print head having an element array in which a plurality of printing elements are arranged in an arranging direction, the method comprising:

a first obtaining step to obtain a first driving pulse comprising a repulse that is applied to the printing elements, and a main pulse that is applied to the printing elements after applying the repulse based on at least a temperature of the print head;

a first determining step performed to determine a second driving pulse comprising the prepulse and the main pulse by adjusting at least a period of the main pulse of the first driving pulse obtained in the first obtaining step;

a second obtaining step to obtain information regarding a total period comprising a period of the prepulse of the second driving pulse, a period of the main pulse of the second driving pulse, and a pause period between the repulse of the second driving pulse and the main pulse of the second driving pulse;

a second determining step to determine a third driving pulse comprising the prepulse and the main pulse based on the second driving pulse determined in the first determining step; and a controlling step to control ejecting ink from the print head by applying the third driving pulse determined by the second determining step to the printing elements, wherein in the second determining step, the third driving pulse is determined, when the total period indicated by the information obtained in the second obtaining step is higher than a threshold value, by adjusting at least a period of the main pulse of the second driving pulse and the pause period of the second driving pulse based on a difference between the total period indicated by the information obtained in the second obtaining step and the threshold value such that a total period of the third driving pulse determined in the second determining step is equal to or lower than the threshold value.

16. An inkjet printing apparatus comprising:

a print head having an element array in which a plurality of printing elements are arranged in an arranging direction;

a first obtaining unit configured to obtain a first driving pulse comprising the prepulse that is applied to the printing element, and the main pulse that is applied to the printing element after applying the prepulse;

a second obtaining unit configured to obtain information regarding a total period comprising a period of the prepulse of the first driving pulse, a period of the main pulse of the first driving pulse, and a pause period between the prepulse of the first driving pulse and the main pulse of the first driving pulse;

a determining unit configured to determine a second driving pulse comprising the prepulse and the main pulse based on the first driving pulse determined by the first determining unit; and a controlling unit configured to control ejecting ink from the print head by applying the second driving pulse determined by the determining unit to the printing elements, wherein the determining unit determines the second driving pulse, (i) in a case that the total period indicated by the information obtained by the second obtaining unit is higher than a threshold value and the difference between the total period indicated by the information obtained by the second obtaining unit and the threshold value is a first value, by (i–1) adjusting the period of the main pulse of the first driving pulse so as to shorten the period of the main pulse of the first driving pulse by a first adjustment value and (i–2) adjusting the pause period of the first driving pulse so as to shorten the pause period of the first driving pulse by a third adjustment value, and (ii) in a case that the total period indicated by the information obtained by the second obtaining unit is higher than the threshold value and the difference between the total period indicated by the information obtained by the second obtaining unit and the threshold value is a second value which is higher than the first value, by (ii–1) adjusting the period of the main pulse of the first driving pulse so as to shorten the period of the main pulse of the first driving pulse by a second adjustment value which is higher than the first adjustment value, and (ii–2) adjusting the pause period of the first driving pulse so as to shorten the pause period of the first driving pulse by a fourth adjustment value which is higher than the third adjustment value, and a ratio of the third adjustment value and the first adjustment value is substantially equal to a ratio of the fourth adjustment value and the second adjustment value.

* * * * *

UNITED STATES PATENT AND TRADEMARK OFFICE

CERTIFICATE OF CORRECTION

PATENT NO. : 9,114,607 B2
APPLICATION NO. : 13/782404
DATED : August 25, 2015
INVENTOR(S) : Yosuke Ishii et al.

It is certified that error appears in the above-identified patent and that said Letters Patent is hereby corrected as shown below:

Claims

COLUMN 15:

Claim 1, Line 41, “repulse” should read --prepulse--;

Line 49, “repulse” should read --prepulse--; and

Line 51, “repulse” should read --prepulse--.

COLUMN 18:

Claim 2, Line 22, “repulse” should read --prepulse--;

Line 24, “repulse” should read --prepulse--; and

Claim 3, Line 34, “repulse” should read --prepulse--.

Signed and Sealed this
Twenty-first Day of June, 2016

Michelle K. Lee

Michelle K. Lee
*Director of the United States Patent and Trademark Office*